United States Patent [19]

Arav

[11] Patent Number: 4,892,203

[45] Date of Patent: Jan. 9, 1990

[54] HOIST SWIVEL SUPPORT HAVING SWIVELABLE SURFACE AND BEARING INSERTS

[75] Inventor: Ronnie A. Arav, Netania, Israel

[73] Assignee: Harnischfeger Corporation, Brookfield, Wis.

[21] Appl. No.: 253,522

[22] Filed: Oct. 5, 1988

[51] Int. Cl.[4] ..... B66C 17/06

[52] U.S. Cl. ..... 212/221; 414/561; 29/434

[58] Field of Search ..... 212/215, 217, 221, 253; 414/542, 543, 561; 29/434, 149.5 R, 149.5 C

[56] References Cited

U.S. PATENT DOCUMENTS

| | | | |
|---|---|---|---|
| 3,410,585 | 11/1968 | Trevisan | 212/253 X |
| 3,933,388 | 1/1976 | Conboy | 414/561 X |
| 4,360,110 | 11/1982 | Sigman et al. | 212/221 X |
| 4,383,478 | 5/1983 | Jones | 29/434 X |

FOREIGN PATENT DOCUMENTS

| | | | |
|---|---|---|---|
| 678887 | 1/1964 | Canada | 212/221 |

*Primary Examiner*—Timothy V. Eley
*Assistant Examiner*—Peter Vo
*Attorney, Agent, or Firm*—Richard C. Ruppin

[57] ABSTRACT

A hoist support and method for fabricating the support are disclosed in which a swivel yoke is provided which has a through opening and is affixed to an overhead frame. A swivel body is affixed to the hoist below the yoke and has a swivel head with a swivelable surface positioned in supporting engagement within the opening in the yoke.

The swivel head both retains the hoist suspended from the overhead frame and permits vertical and horizontal swiveling movement of the hoist relative to the frame. The swivel yoke may include bearing inserts supporting the swivel head within the opening in the yoke and providing a replaceable bearing surface.

6 Claims, 3 Drawing Sheets

HOIST SWIVEL SUPPORT HAVING SWIVELABLE SURFACE AND BEARING INSERTS

FIELD OF THE INVENTION

This invention relates to a swivel support apparatus for a hoist and to a method of making the swivel support. In particular, the invention relates to a simplified swivel support for suspendibly supporting a hoist from an overhead frame and a method of fabricating and assembling the swivel support.

BACKGROUND OF THE INVENTION

Hoists are commonly supported in a suspended manner with a fixed mounting or a swivel mounting. Fixed mounting arrangements are preferred due to their simplicity and because the mounting height of a fixed arrangement is smaller than that of swivel mounting arrangements. However, fixed mountings cannot be used in all applications and swivel mountings must be used in some situations irrespective of their complexity and excessive mounting height. Swivel mountings are required in those cases where two mounting supports are needed for one hoist and the hoist is mounted on a trolley which travels on a curved beam or similar guide track support. Swivel mountings are also needed in those situations where the load must be rotated in its handling or transporting or where the load swings or moves such that bending stress is applied to the mounting mechanism. In general, swivel mountings are required in applications where flexibility between the hoist and its supporting apparatus, such as a trolley, is required.

A typical swivel mounting apparatus includes an attachment lug on the top of a hoist frame and a supporting yoke affixed to the bottom portion of a trolley from which the hoist is suspended. A second yoke member may be positioned between the trolley yoke and the hoist top lug and bolted to the hoist top lug in a manner permitting pivoting motion of the hoist relative to the trolley about a single horizontal axis. A bolt is extended through the trolley yoke and the second yoke member and has a nut at its bottom end which retains the hoist on the trolley. The bolt passes through thrust bushings which engage the trolley yoke and the second yoke member and permit the pivoting movement about the vertical axis. Thus, this type of swivel mounting permits a swivel motion of the hoist relative to the trolley due to the horizontal and vertical pivoting motion provided by the swivel mounting. As may be appreciated, such a swivel mounting is fairly complex and occupies a substantial mounting height due to the various mounting lugs, yoke members, and bolts and bushings required to provide the support in a swivelable manner.

SUMMARY OF THE INVENTION

It is an object of this invention to provide a swivel support for a hoist which is simple in construction, easy to fabricate, and occupies little height in suspendibly supporting a hoist from an overhead frame.

The invention is accomplished by affixing a swivel yoke having a through opening to an overhead frame. A swivel body is affixed to the hoist below the support and has a swivel head with a swivelable surface positioned in supporting engagement with the opening in the yoke.

The swivel head both retains the hoist suspended from the overhead frame and permits swiveling movement of the hoist relative to the frame. The swivel yoke may include bearing inserts supporting the swivel head and providing a replaceable bearing surface.

The swivel support is fabricated by forming a swivel body with an enlarged upper swivel head and forming a yoke with a through opening and an enlarged opening portion at an upper end of the yoke. The swivel body is positioned in the opening in the yoke with the swivel head in engagement with the enlarged opening portion. An attachment member connecting the hoist to the support is affixed to the lower end of the swivel body. The swivel head may be extended into the yoke through opening subsequent to affixing the hoist to the lower end of the swivel body. Bearing inserts are then positioned between the swivel head and yoke opening and the head is seated and supported on the inserts.

BRIEF DESCRIPTION OF THE DRAWINGS

Further objects and advantages of the invention will appear when taken in conjunction with the accompanying drawings in which.

DETAILED DESCRIPTION OF THE INVENTION

Figure 1:
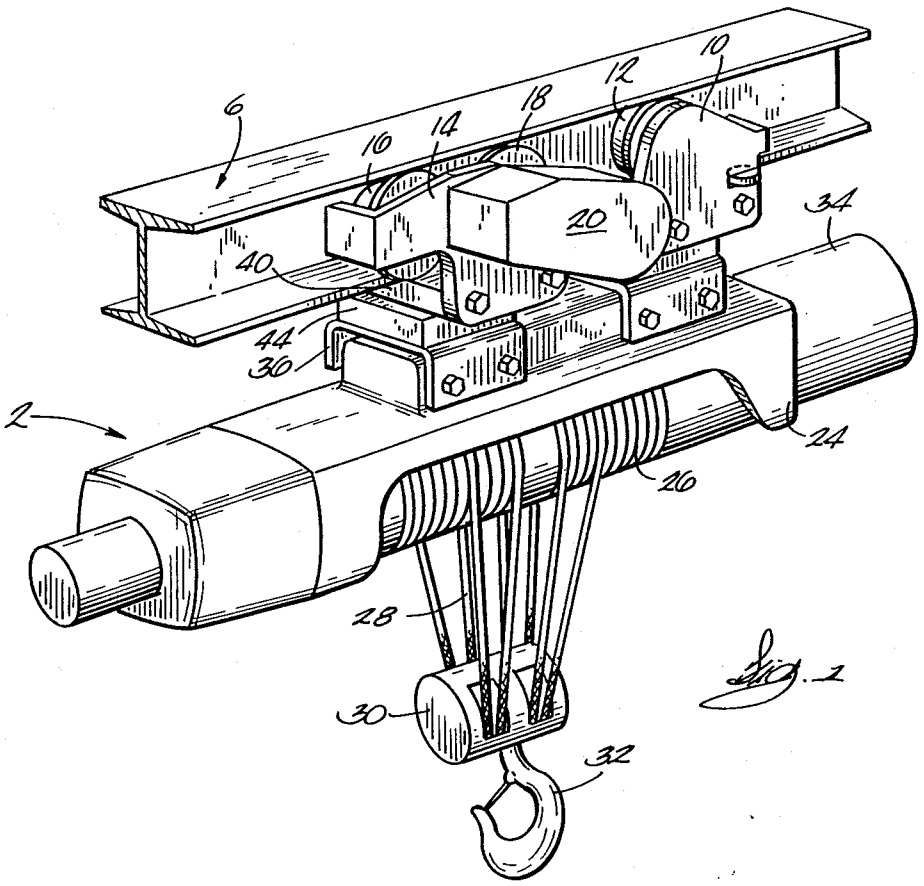
FIG. 1 is a perspective view of a hoist suspended from a trolley and incorporating the swivel support according to the invention.
Figure 2:
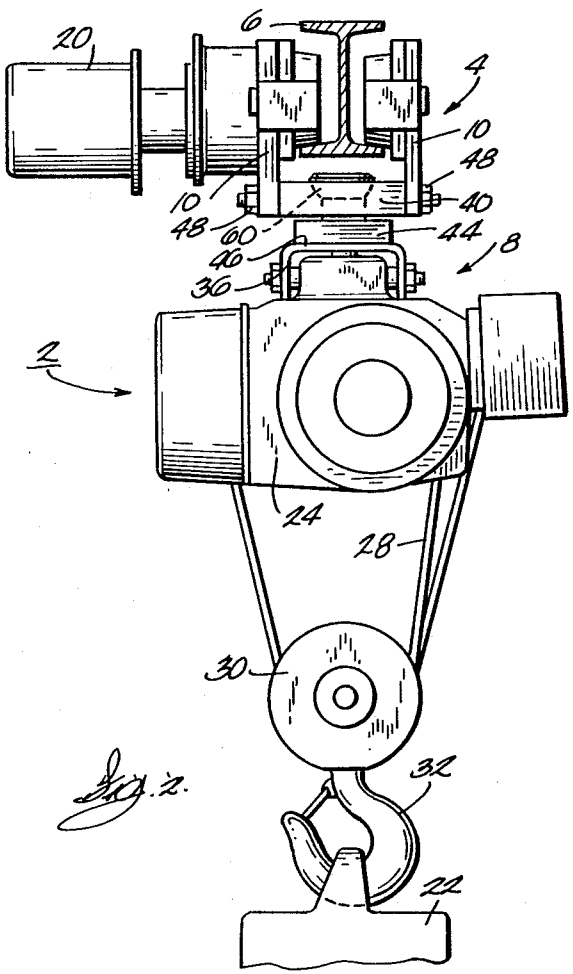
FIG. 2 is an end view of the hoist illustrated in FIG. 1.

Referring generally to FIGS. 1 and 2, a hoist 2 is illustrated as being suspendibly supported from a trolley 4 which, in turn, is moveably supported on a guide track 6. The trolley 4 and hoist 2 together travel along the track 6 to transport a load object 22 that may be carried by the hoist 2. The trolley 4 includes a pair of side plates 10 on which a pair of idler wheels 12 are rotatably mounted and a pair of side plates 14 on which a pair of idler wheels 16 and a pair of drive wheels 18 are rotatably mounted. A motor and gear drive 20 is also mounted on the side plates 14 and connected to the drive wheels 18 for moving the hoist 2 and trolley 4 along the guide track 6. The hoist 2 includes a frame 24, a top lug 36 attached to the frame 24 for connecting the hoist to the trolley, a rotatable drum 26 mounted on the frame 24 and having a cable 28 attached to it, a block and sheave 30 carried by the cable 28, and a load hook 32 connected to the block and sheave 30. A motor and gear drive 34 is also mounted on the hoist frame 24 and is coupled to the drum 26 to rotate the drum in a load raising or lowering direction. The cable 28 is thereby wound onto or off of the drum 26 to raise or lower the load 22 on the hook 32.

The swivel support 8 includes, with reference to FIGS. 1, 2, 3A and 3B, a swivel yoke 40 and a swivel body 42. The yoke 40 is mounted on the side plates 10 of the trolley by suitable means such as threaded studs and nuts 48. The yoke 40 is formed with a through opening 50 having an enlarged portion 52 at the upper end 54 of the yoke. The swivel body 42 includes a hoist attachment member 44 and an upper member 56 having a shank 58 and a swivel head 60. The swivel body is affixed to the top lug 36 of the hoist frame by means such as welding the member 44 to the upper surface 46 of the lug 36. The swivel head 60 has a swivelable surface 62 which fits in supporting engagement with a swivel surface 64 of the enlarged portion 52 of the through opening 50 in yoke 40. The swivelable surface 62 and the swivel surface 64 have mating arcuate surfaces defined by a section of an arc of a circle rotated 360 degrees about an axis at a constant position along the length of the axis. The surfaces 62 and 64 may each have a shape which is part of a section of a sphere. The seating of the swivelable surface 62 of the head 60 in engagement with surface 64 performs two functions. First, the hoist is supported in a suspended manner from the trolley 2. Secondly, the ability of the swivel head 60 to pivot about both a vertical axis and any horizontal axis provides the hoist 2 with the entire flexible movement that it requires in lifting and carrying the load object 22.

Figure 3A:
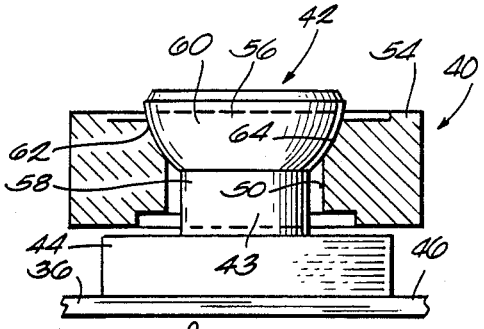
FIG. 3A is a side view, partially in cross-section, of the swivel support according to the invention.
Figure 3B:
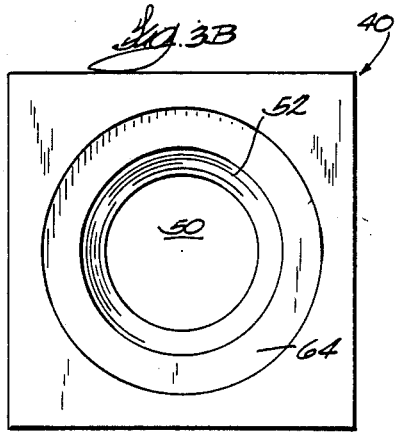
FIG. 3B is a plan view of the yoke of the swivel support shown in FIG. 3A.
Figure 4A:
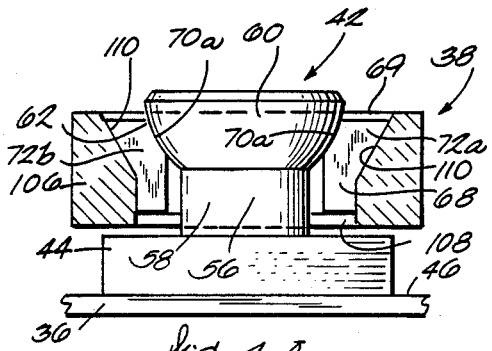
FIG. 4A is a side view, partially in cross-section, illustrating an alternative embodiment of the invention.
Figure 4B:
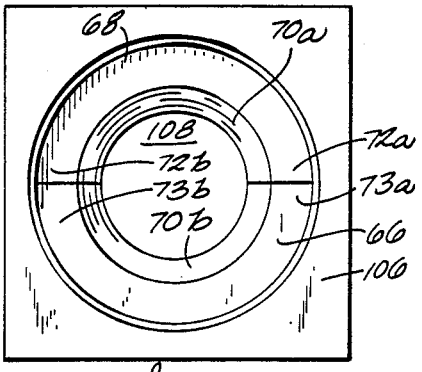
FIG. 4B is a plan view of the yoke of the swivel support illustrated in FIG. 4A.
Figure 6:
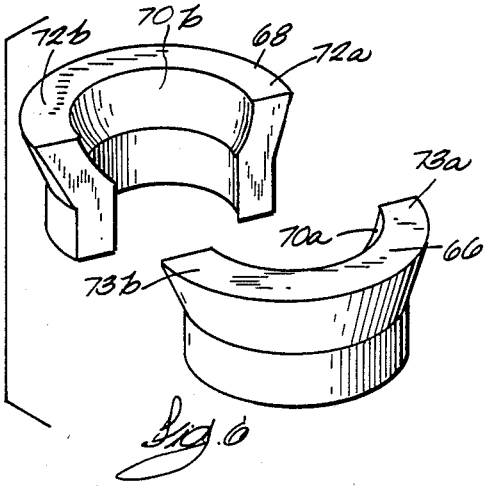
FIG. 6 is a perspective view of bearing inserts utilized in the embodiment of the invention illustrated in FIGS. 3A and 3B.

Another embodiment of the invention is illustrated in FIGS. 4A, 4B and 6 in which components of the swivel support which differ from those of the embodiment illustrated in FIGS. 3A and 3B are identified by different numerals. In the embodiment shown in FIG. 4A, the swivel body 42 is identical to that shown in FIG. 3A and consequently its description need not be repeated. The yoke 38 includes a body member 106 having a through opening 108 which, in turn, has an enlarged portion 69 having a conical shaped seating surface 110. A pair of half-circular bearing inserts 66 and 68 are seated against the seating surface 110 and respectively include arcuate bearing surfaces 70*a* and 70*b*. The insert 66 also has ends 72*a* and 72*b* and the insert 68 has ends 73*a* and 73*b*. The ends 72*a* and 73*a*, and the ends 72*b* and 73*b* face each other when the inserts 66 and 68 are positioned against the seating surface 110 to form a substantially continuous circular arcuate bearing surface for receiving the swivel head 60. In the seated position of the swivel head 60, its swivelable surface 62 is in movable engagement with the bearing surfaces 70*a* and 70*b* of the inserts 66 and 68, as shown in FIG. 4A. In the view of FIG. 4B, the bearing inserts 66 and 68 are in the inserted position they occupy for swivelable support of the head 60, however, the head 60 and the rest of the swivel body 42 are not shown. The benefit of the inserts 66 and 68 is the ability to provide a high hardness wear surface without hardening the entire swivel body 42 and to permit easy replacement of the inserts if the surfaces 70*a* and 70*b* do wear to an unsatisfactory extent. In addition, the use of the two separate inserts 66 and 68 permits the large through opening 108 to facilitate the assembly of the swivel support 8 during its manufacture.

Figure 5:
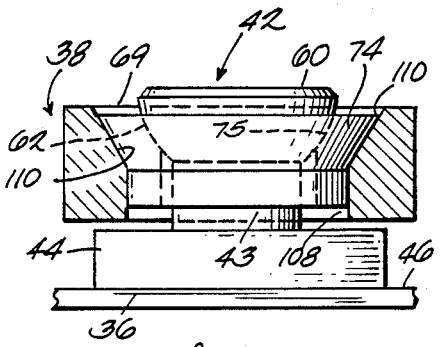
FIG. 5 is a side view, partially in cross-section, illustrating an alternative embodiment of the invention.

In another alternative embodiment of the invention, illustrated in FIG. 5, the swivel body 42 and the body member 106 are identical to those shown in FIGS. 4A and 4B. However a full circle bearing insert 74 having a continuous circular and arcuate spherical bearing surface 75 is seated against the seating surface 110. The full circle bearing insert 74 functions in substantially the same manner as the pair of bearing insert halves 66 and 68 and provides the benefit of providing only a limited part of the swivel body with a high hardness wear surface. However, the bearing insert 74 does not provide the benefit of facilitating the assembly of the swivel support 8.

The manufacture of the swivel support 8 may be accomplished using one of several alternative methods. With respect to the embodiment of the swivel support 8 illustrated in FIGS. 3A and 3B, the swivel yoke 40 is fabricated with the through opening 50 having a minimum diameter at least large enough to enable the positioning of the shank 58 of the swivel body 42 in and through the opening 50. The upper end 54 of the yoke 40 is formed in a spherical shape to receive and seat the swivel head 60. The swivel body 42 is formed with the upper member 56 having the shank 58 and the swivel head 60 having the swivelable surface 62 of a spherical shape that will fit in mating engagement with the surface 64 of the enlarged portioned 52 of the opening 50 in the yoke. After positioning of the swivel body 42 in the opening 50, at the lower end 43 of the swivel body, a hoist attachment member 44 is affixed to the swivel body, preferably as an integral part of the swivel body. The hoist support 8 thus is a captive assembly of the swivel yoke 40 and the swivel body 42 in the embodiment of the invention as shown in FIGS. 3A and 3B. The hoist attachment member 44 and the yoke 40 may then be respectively affixed to the hoist frame 24 and the side plates 10 of the trolley 4.

In the manufacture of the embodiment of the invention shown in FIG. 5, the swivel yoke 40 is initially formed with the enlarged section 69 having seating surface 110 to receive the full circle bearing insert 74. The bearing insert 74 is formed with the arcuate bearing surface 75 matching the spherical shape of the swivelable surface 62 of the swivel head 60. The bearing insert 74 is then positioned in the enlarged section 69 of the yoke 40 and the swivel body 42 is positioned in the opening 50 of the yoke 40 and the head 60 seated against the swivel surface 75 of the bearing insert 74. The hoist attachment member 44 is then affixed to the lower end 43 of the swivel body as described with reference to the embodiment of the invention shown in FIGS. 3A and 3B.

In the manufacture of the alternative embodiment of the invention illustrated in FIGS. 4A and 4B, the swivel body 42 is formed with a swivel head 60 as described with reference to the embodiments of the invention shown in FIGS. 3A and 3B. However, prior to fitting of the swivel body 42 and the swivel yoke 40 together, the hoist attachment member 44 is affixed to the lower end 43 of the swivel body 42 and thus formed as an integral part of the body 42. The swivel yoke 40 is formed with the enlarged section 69 and the through opening 50 of a sufficient size to permit the extending of the swivel body 42 including its head 60 through the opening 50. The swivel body 42 is then extended through the opening 50 and held in a position spaced from the seating surface 110 of the enlarged section 69 a distance sufficient to permit insertion of the two bearing insert halves 66 and 68 into the enlarged section 69. The bearing halves 66 and 68 are then inserted into the enlarged section 69 and against the seating surface 110. The swivel body 42 is then released to permit the head 60 to move into engagement with the swivel bearing surfaces 70a and 70b as shown in FIG. 4B.

Figure 7A:
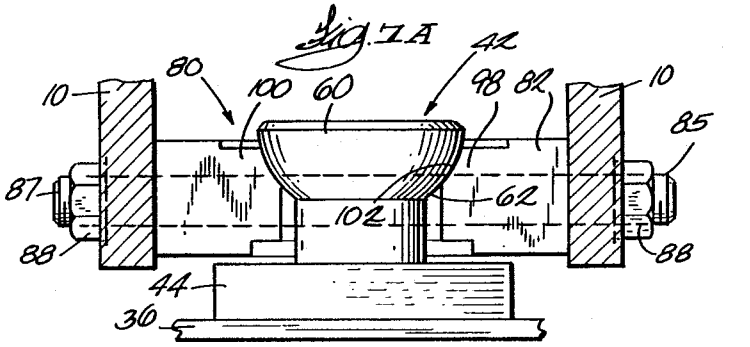
FIG. 7A is a side view, partially in cross-section and broken away, illustrating another alternative embodiment of the invention.
Figure 7B:
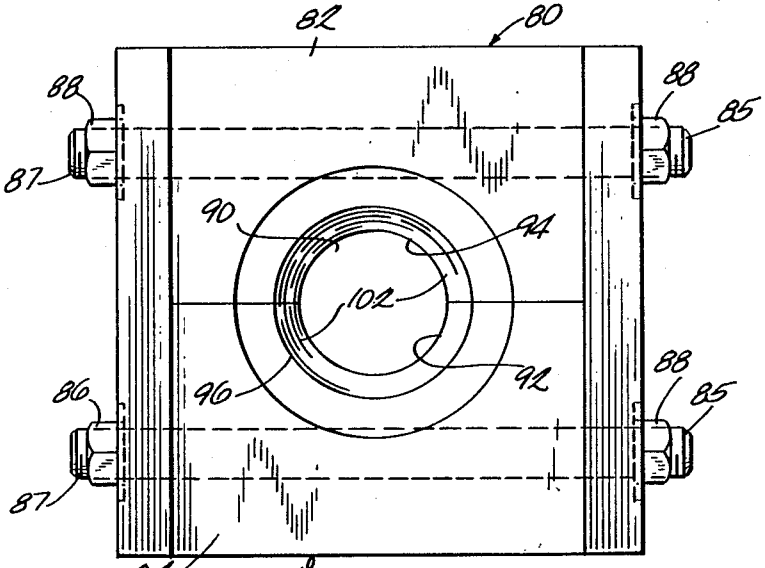
FIG. 7B is a plan view of a part of the alternative embodiment of the invention illustrated in FIG. 7B.

In another alternative embodiment of the invention, illustrated in FIGS. 7A and 7B the swivel body 42 is identical to the swivel body 42 shown in the embodiment of FIG. 3A, however, the swivel yoke differs and accordingly is described with the use of different numerals identifying its components. Referring to FIGS. 7A and 7B, a swivel yoke 80 is utilized which comprises two facing and engaging yoke members 82 and 84. The yoke member 82 is mounted on the trolley side plates 10 by a stud 85 and nut pairs 86 and the yoke member 84 is mounted on the side plates 10 of the trolley by a stud 87 and nut pairs 88. The yoke pair 82 and 84, when mounted in facing engagement, form a through opening 90 formed by through opening half 92 in member 82 and through opening half 94 in member 84. The through opening 90 has an enlarged portion 96 provided by facing enlargements in the upper ends 98 and 100 of the yoke pair 82 and 84. When the yoke pair 82 and 84 are in facing engagement, the enlarged portion 96 has a spherical swivel bearing surface 102 which receives the swivelable surface 62 of the swivel head 60.

The swivel support 8 illustrated in FIGS. 7A and 7B is manufactured by forming the swivel body 42 in the same manner as described with reference to the embodiment of the swivel support 8 illustrated in FIG. 3A. The swivel yoke 80 is fabricated by forming the facing yoke pair 82 and 84 respectively with the facing sections 92 and 94 of the through opening 90. The two yoke pairs 82 and 84 are positioned in engagement with each other such they surround the swivel body 42. The yoke pairs 82 and 84 are then affixed to the side plates 10 of the trolley 4 by means of the studs 85, 87 and nut pairs 86 and 88.

A swivel support has been described which comprises relatively few parts and is simple and economical to manufacture. The swivel support also occupies a relatively small height when supporting a hoist due to the use of the swivel head both as the means of support of the hoist from an overhead support and as the swivelable surface of the swivel assembly. Moreover, the use of a spherical shape for the swivel head in engagement with the yoke opening permits pivoting movement about a vertical axis and about all horizontal axes to thereby provide a complete swivel motion with the use of only one swiveling surface as opposed to prior devices using several different components to accomplish this swiveling capability.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. In a hoist suspended from and travelable along a track means for raising, transporting and lowering material, the hoist including a frame, a rotatable drum mounted on the frame, a cable connected to and windable on to and off of the drum, a load hook attached to the cable for holding the material as the cable is wound on to or off of the drum when the drum rotates in one of said directions whereby the material is raised or lowered, the combination comprising:

trolley means supported on and movable along the track means for carrying the hoist in a suspended manner and including a swivel yoke having an opening therethrough, the opening having a support surface;

a swivel body affixed to the hoist frame and having an upper member projecting through the opening in the swivel yoke, the upper member including a swivel head having a swivelable surface;

a plurality of swivel bearing inserts each movable from a position exteriorly of said opening to a position within said opening between the swivelable surface of the swivel head and the support surface of the swivel yoke; and the swivelable surface of the swivel body is in supporting engagement with the swivel bearing inserts whereby the hoist frame is supported by the trolley means and the hoist frame and drum are free to rotate relative to the trolley means.

2. In a hoist suspended from and travelable along a track means for raising, transporting and lowering material, the hoist including a frame, a rotatable drum mounted on the frame, a cable connected to and windable on to and off of the drum, a load hook attached to the cable for holding the material as the cable is wound on to or off of the drum when the drum rotates in one of said directions whereby the material is raised or lowered, the combination comprising:

trolley means supported on and movable along the track means for carrying the hoist in a suspended manner and including a swivel yoke having an opening therethrough, the opening having a support surface;

a swivel body affixed to the hoist frame and having an upper member projecting through the opening in the swivel yoke, the upper member including a swivel head having a swivelable surface, the swivelable surface having a first position at a predetermined spacing from the support surface of the yoke;

a plurality of swivel bearing inserts each movable from a position exteriorly of said opening to a position engaging the support surface of the swivel yoke within said opening between the swivelable surface of the swivel head in said first position and the support surface; and the swivelable surface of the swivel body has a second position in supporting engagement with the swivel bearing inserts when the latter are in their position within the opening whereby the hoist frame is supported by the trolley means and the hoist frame and drum are free to rotate relative to the trolley means.

3. In a hoist suspended from and travelable along a track means for raising, transporting and lowering material, the hoist including a frame, a rotatable drum mounted on the frame, a cable connected to and windable on to and off of the drum, a load hook attached to the cable for holding the material as the cable is wound on to or off of the drum when the drum rotates in one of said directions whereby the material is raised or lowered, the combination comprising:

trolley means supported on and movable along the track means for carrying the hoist in a suspended manner and including a swivel yoke having an opening therethrough;

a swivel body including a swivel head and a shank connected between the swivel head and the base member, the swivel head having a swivelable surface and a predetermined diameter; and the swivel yoke includes an opening section around the shank of the swivel body which is smaller than the base member and the diameter of the swivel head, being in supporting engagement with the opening, whereby the swivel head retains the base member and thereby the hoist frame and drum in suspended relationship with the trolley and permits swivel movement of the hoist relative to the trolley.

4. In a hoist suspended from and travelable along a track means for raising, transporting and lowering material, the hoist including a frame, a rotatable drum mounted on the frame, a cable connected to and windable on to and off of the drum, a load hook attached to the cable for holding the material as the cable is wound on to or off of the drum when the drum rotates in one of said directions whereby the material is raised or lowered, the combination comprising:

trolley means supported on and movable along the track means for carrying the hoist in a suspended manner;

a swivel yoke affixed to the trolley means and having a through opening including a lower section and upper section enlarged relative to the lower section; and a swivel body affixed to the hoist frame and having an upper member projecting through the opening in the swivel yoke, the upper member including a swivel head having a swivelable surface in supporting engagement with the upper section of the opening in the swivel yoke whereby the hoist frame is supported by the trolley means and the hoist frame and drum are free to rotate relative to the trolley means.

5. In a hoist suspended from and travelable along a track means for raising, transporting and lowering material, the hoist including a frame, a rotatable drum mounted on the frame, a cable connected to and windable on to and off of the drum, a load hook attached to the cable for holding the material as the cable is wound on to or off of the drum when the drum rotates in one of said directions whereby the material is raised or lowered, the combination comprising:

trolley means supported on and movable along the track means for carrying the hoist in a suspended manner and including a swivel yoke having an opening therethrough; and a swivel body affixed to the hoist frame and having an upper member projecting through the opening in the swivel yoke, the upper member including a swivel head having a swivelable surface in supporting engagement with the opening in the swivel yoke and being rotatable about both vertical and horizontal axes, whereby the hoist frame is supported by the trolley means and the hoist frame and drum are free to rotate relative to the trolley means.

6. In a hoist suspended from and travelable along a track means for raising, transporting and lowering material, the hoist including a frame, a rotatable drum mounted on the frame, a cable connected to and windable on to and off of the drum, a load hook attached to the cable for holding the material as the cable is wound on to or off of the drum when the drum rotates in one of said directions whereby the material is raised or lowered, the combination comprising:

trolley means supported on and movable along the track means for carrying the hoist in a suspended manner;

a swivel yoke affixed to the trolley means and having a through opening, the yoke comprising two plate members engaging each other and each having a facing half opening, the two half openings of the plates forming the opening in the yoke; and a swivel body affixed to the hoist frame and having an upper member projecting through the opening in the swivel yoke, the upper member including a swivel head having a swivelable surface in supporting engagement with the opening in the swivel yoke whereby the hoist frame is supported by the trolley means and the hoist frame and drum are free to rotate relative to the trolley means.

* * * * *